US008878876B2

(12) United States Patent
Chen et al.

(10) Patent No.: US 8,878,876 B2
(45) Date of Patent: Nov. 4, 2014

(54) SYSTEMS AND METHODS FOR MANAGING THE POSITIONING AND SIZING OF OBJECTS IN ELECTRONIC CONTENT

(75) Inventors: Winsha Chen, Redwood City, CA (US); Peter S. Flynn, San Francisco, CA (US)

(73) Assignee: Adobe Systems Incorporated, San Jose, CA (US)

( * ) Notice: Subject to any disclaimer, the term of this patent is extended or adjusted under 35 U.S.C. 154(b) by 827 days.

(21) Appl. No.: 12/905,345

(22) Filed: Oct. 15, 2010

(65) Prior Publication Data

US 2014/0085338 A1 Mar. 27, 2014

(51) Int. Cl.
*G09G 5/00* (2006.01)

(52) U.S. Cl.
USPC ..... 345/660; 345/649

(58) Field of Classification Search
CPC ..... G06F 9/4443; Y10S 707/99942
USPC ..... 345/660; 715/853
See application file for complete search history.

(56) References Cited

U.S. PATENT DOCUMENTS

2009/0228838 A1* 9/2009 Ryan et al. ..... 715/853
2010/0011306 A1* 1/2010 Ruff et al. ..... 715/763

OTHER PUBLICATIONS

"Using Adobe Flash Catalyst CS5," Adobe Systems Incorporated, 2010.

* cited by examiner

*Primary Examiner* — Kee M Tung
*Assistant Examiner* — Peter Hoang
(74) *Attorney, Agent, or Firm* — Kilpatrick Townsend & Stockton LLP

(57) ABSTRACT

One exemplary embodiment involves receiving, in an electronic content creation application, provided on a computer device, input for an object of electronic content being edited in the electronic content creation application. The input modifies a position attribute or a size attribute of the object in at least one state of the multiple states relative to bounds that is the same for multiple states of the object. The electronic content creation application determines whether to update the bounds associated with the object based on the input and, if updating the bounds is necessary, it updates the bounds associated with the object and, based on the update of the bounds, updates the position attribute or the size attribute.

22 Claims, 14 Drawing Sheets

SYSTEMS AND METHODS FOR MANAGING THE POSITIONING AND SIZING OF OBJECTS IN ELECTRONIC CONTENT

FIELD

This disclosure relates generally to computer software that runs, displays, provides, shares, or otherwise uses electronic content.

BACKGROUND

Various computer applications are used to create graphics, applications, animations, videos, and other electronic content. Many such applications provide a what-you-see-is-what-you-get (WYSIWYG) interface that allows the appearance of the electronic content being created to be specified on a graphical canvas area. However created, electronic content can involve displaying, animating, or otherwise playing various types of visually-perceptible objects. Geometric shapes, images, pictures, and text are examples of such objects. How such objects are positioned in the electronic content can vary and may depend upon the particular type of electronic content. On web pages, rich Internet applications, and various other types of electronic content, the position of objects is often defined in a creation application with reference to an aspect of the electronic content. For example, an object's position may be defined with respect to distance from one or more of the edges of the electronic content's display area.

While defining object positioning with respect to content edges is useful, it is also often desirable to create and use more complicated object layouts. Content creators, for example, often find it useful to define object positioning with respect to other content objects. For example, all of the individual objects that make up a button may be defined as parts of a single group so that the button can be moved, rotated, resized, or otherwise edited more efficiently in a content creation application. Those individual objects that make up the button may each have a position that is defined by reference to a bounds associated with the entire group of objects. Those bounds may be different from the edges of the electronic content. In one particular example, a button component is implemented as a parent component and the individual objects that make up the button are defined as child components such that their position is defined relative to bounds associated with the parent button component.

SUMMARY

One exemplary embodiment involves receiving, in an electronic content creation application provided on a computer device, input for an object of electronic content being edited in the electronic content creation application. The input modifies a position attribute or a size attribute of the object in at least one state of the multiple states relative to bounds that is the same for multiple states of the object. The electronic content creation application determines whether to update the bounds associated with the object based on the input and, if updating the bounds is necessary, it updates the bounds associated with the object and, based on the update of the bounds, updates the position attribute or the size attribute.

A second exemplary embodiment involves receiving, in an electronic content creation application provided on a computer device, input for an object of electronic content being edited in the electronic content creation application. Prior to the input, there was a first association between the object and the first bounds such that changing the first bounds changes a position attribute or a size attribute of the object. Based on the input, the electronic content creation application determines to remove the first association and create a second association between the object and the second bounds such that changing the second bounds changes the position attribute or the size attribute of the object. The electronic content creation application also creates a third association between the second bounds and the first bounds such that changing the first bounds changes the second bounds to preserve a position or size of the object relative to the first bounds.

These illustrative embodiments are mentioned not to limit or define the disclosure, but to provide examples to aid understanding thereof. Additional embodiments are discussed in the Detailed Description, and further description is provided there.

BRIEF DESCRIPTION OF THE FIGURES

These and other features, aspects, and advantages of the present disclosure are better understood when the following Detailed Description is read with reference to the accompanying drawings, where.

DETAILED DESCRIPTION

Figure 1:
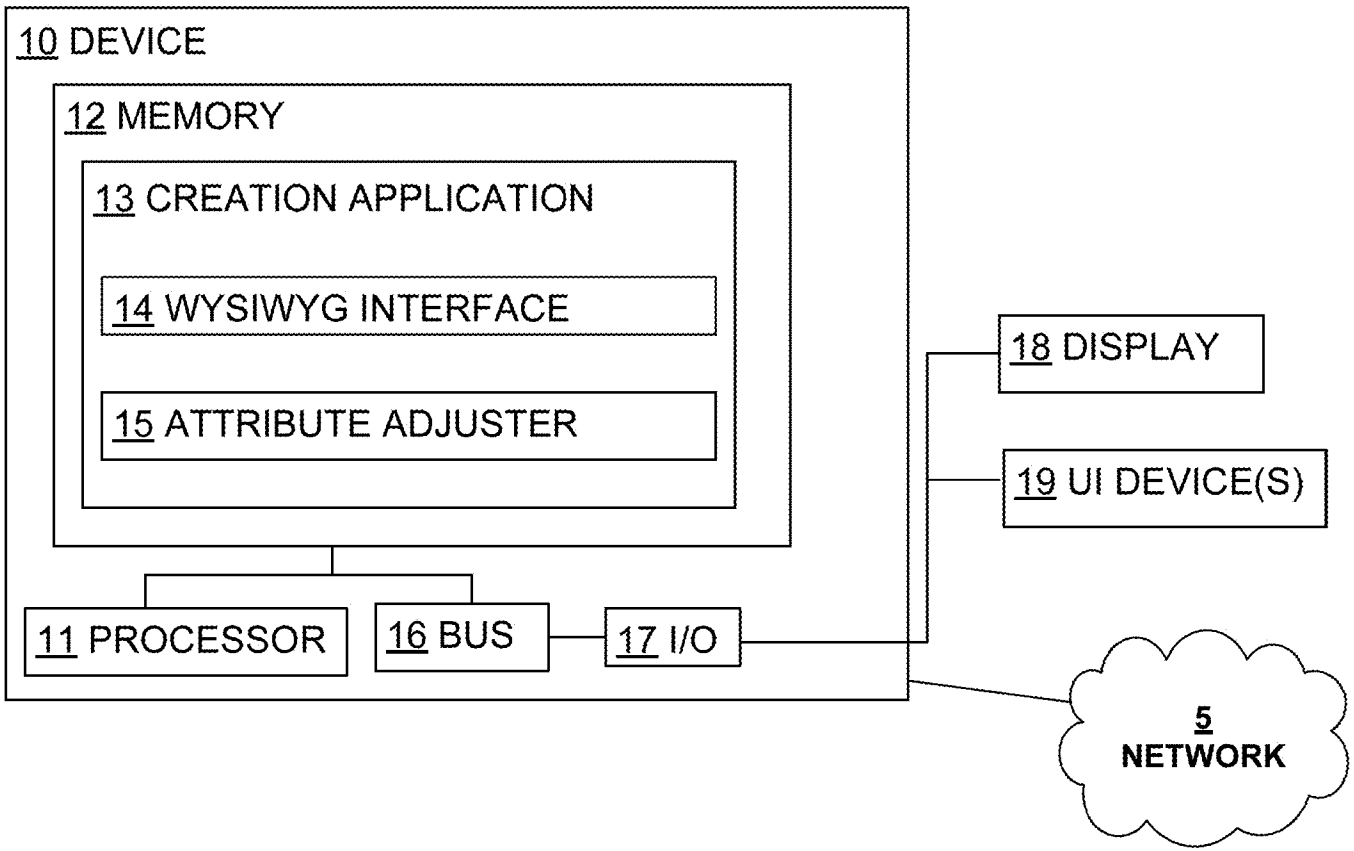
FIG. 1 depicts an exemplary computing environment for creating electronic content.

Methods and systems are disclosed that manage the positioning and sizing of objects in electronic content. One exemplary embodiment facilitates the creation and editing of a parent object that has a position and size or bounds that is defined by its child objects. The bounds of such a parent object may be adjusted during editing of the electronic content in ways such that the bounds is the same across all of the multiple states. Thus, an edit made with respect to one state may result in a change to the bounds across all states. In many circumstances, it is desirable to ensure that all child objects are within the bounds of the parent object. It may also be desirable to minimize the bounds such that, for example, the bounds provides a rectangle of minimum dimensions that is constant across the multiple states but that encompasses each of the child objects in any of the states. When electronic content is edited, the bounds may be adjusted to ensure that these requirements are satisfied. Thus, moving a child object may result in the bounds of the parent object being extended or reduced in one or more direction to accommodate the new position of the child object.

Managing the positioning and sizing of objects in multi-state electronic content may also involve managing constraints. Constraints are attributes that define the position or size of an object in one or more states relative to a bounds. Constraints are particularly useful when used in resizable parent objects that have child objects the positions of which are constrained relative to one or more bounds of the parent. When the parent is resized and the bounds is changed, the child objects are repositioned and/or resized according to the constraints. Thus, if a text object is constrained to a position 50 pixels from the right edge of its parent window object, when the window is resized by an end-user of the electronic content, the text will move to maintain the 50 pixel distance from the right edge of the parent window object.

Managing the positioning and sizing of objects in multi-state electronic content may also involve responding to edits of the electronic content that constrain child objects, editing the visual bounds of child objects, or adding child objects. Such edits may result in updating the origin and/or size of the parent object to ensure that all its child objects remain within its bounds in all of its different states. If the origin of such a parent object bounds is updated, corresponding updates may be made to any child object attribute that refers to the updated bounds. Thus, if positions of a child objects are specified as a constraint relative or an edge or as an x/y position relative to an origin, these references can be changed based on changes to the parent object bounds. As specific examples, left/top constraints and x/y positions of the child objects can be adjusted to prevent those objects from moving in an unintended manner.

Managing the positioning and sizing of objects in multi-state electronic content may also involve preventing collapse and other errors. Electronic content may be developed with a parent object and child objects whose sizes depend upon one another, i.e., objects the positions and sizes of which are recursively defined. Managing the positioning and sizing of objects can involve preventing such definitions from causing errors. For example, in applying constraints, the width and/or height of a parent object can be managed so that objects do not collapse in on themselves based on an edit. For example, if a first object has a right constraint, when the user adds or removes another object that defines the right/bottom edge, the size of the first object and right/bottom constrained objects may be adjusted to prevent a collapse or other error.

Generally, managing the positioning and sizing of objects in multi-state electronic content by automatically managing bounds and/or object attributes can provide various benefits. For example, it may help keep the electronic content stable across multiple states and prevent objects from collapsing and/or moving in unexpected ways in response to edits. One embodiment provides an on-the-fly, multi-state adjustment in response to edits received from a user that makes it simpler for content creators to create electronic content. One embodiment provides a user interface that allows a content creator to use the automatic adjustment features or to alternatively manually adjust bounds. Where bounds are manually adjusted the content creation application can update any object constraints or other attributes to ensure that objects respond as expected in response to the changed bounds.

FIG. 1 depicts an exemplary computing environment for creating electronic content. The methods and systems disclosed herein are also applicable on other computing systems and environments. The environment shown in FIG. 1 comprises a wired or wireless network 5 to which device 10 is connected. In one embodiment, the network 5 comprises the Internet. In other embodiments, other networks, intranets, or combinations of networks may be used. Other embodiments do not involve a network and may, for example, provide features on a single device or on devices that are directly connected to one another. Other alternative networks, computers, and electronic device configurations are also possible.

As used herein, the term "device" refers to any computing or other electronic equipment that executes instructions and includes any type of processor-based equipment that operates an operating system or otherwise executes instructions. A device will typically include a processor that executes program instructions and may include external or internal components such as a mouse, a CD-ROM, DVD, a keyboard, a display, or other input or output equipment. Examples of devices are personal computers, digital assistants, personal digital assistants, cellular phones, mobile phones, smart phones, pagers, digital tablets, laptop computers, Internet appliances, other processor-based devices, and television viewing devices. The exemplary device 10 is used as a special purpose computing device to provide specific functionality offered by its applications. As an example, device 10 is shown with a display 18 and various user interface devices 19. A bus, such as bus 16 will typically be included in a device.

As used herein, the phrase "electronic content" refers to any text, graphics, video, audio, application, executable code, or other material that can be stored on and/or presented on or through a computer or other device. A piece of electronic content can be provided as one or more electronic files and developed as part of a single content creation project. An electronic content creation application may open such electronic content for editing, for example, such that edits made using the electronic content creation application result in changes to the one or more electronic files that define or otherwise make up the piece of electronic content being created.

As used herein, the term "object" refers to any component, representation, graphic, element, or anything else that is or can be displayed as a part of electronic content. An object may comprise features and attributes that define, specify, influence, or affect how the item appears, behaviors, or is otherwise used in electronic content. An object may have features and attributes that include one or more other objects within the item or that otherwise associate the object with one or more other objects, for example, though a parent/child relationship.

As used herein, the term "multi-state content" refers to content in which the content itself and/or one or more objects of the content are associated with more than one state. Each state specifies a particular configuration, relationship, and/or selection of properties for objects associated with that state. A given object may be associated with one or more of states in multi-state content. In some, but not all, electronic content different states are associated with different positions along a timeline. In some, but not all, electronic content different states are associated with different events determined during use of the content. As a specific example, a button object might be associated with an "up" state and a "down" state.

As used herein, the term "application" refers to any program instructions or other functional components that execute on a device. An application may reside in the memory of a device that executes the application. As is known to one of skill in the art, such applications may be resident in any suitable computer-readable medium and execute on any suitable processor. For example, as shown the device 10 comprises a computer-readable medium as memory 12 coupled to a processor 11 that executes computer-executable program instructions and/or accesses stored information. Such a processor 11 may comprise a microprocessor, an ASIC, a state machine, or other processor type, and can be any of a number of computer processors. Such a processor comprises, or may be in communication with a computer-readable medium which stores instructions that, when executed by the processor, causes the processor to perform the steps described herein.

A computer-readable medium may comprise, but is not limited to, an electronic, optical, magnetic, or other storage device capable of providing a processor with computer-readable instructions. Other examples comprise, but are not limited to, a floppy disk, CD-ROM, DVD, magnetic disk, memory chip, ROM, RAM, an ASIC, a configured processor, optical storage, magnetic tape or other magnetic storage, flash memory, or any other medium from which a computer processor can read instructions. The instructions may comprise processor-specific instructions generated by a compiler and/or an interpreter from code written in any suitable computer-programming language, including, for example, C, C++, C#, Visual Basic, Java, Python, Perl, JavaScript, and ActionScript.

In FIG. 1, device 10 comprises a creation application 13 that is used by content creators to create electronic content. The creation application 13 provides a what-you-see-is-what-you-get (WYSIWYG) interface 14 and an attribute adjuster 15. Each of the WYSIWYG interface 14 and attribute adjuster 15 may be implemented as individual modules that provide specific functionality of the creation application 13. For example, the exemplary WYSIWYG interface 14 may be configured to receive input for an object of electronic content being edited. Such input may, for example, modify a position or size of the object in at least one state of the multiple states. The object may be associated with, and the WYSIWYG interface 14 may display a representation of, bounds used for multiple states of the object. The bounds is preferably the same across the different states. The attribute adjuster 15 may be configured to update bounds of the object based on the input to the WYSIWYG module and to update the position or size of the object based on the update of the bounds. In one particular example, the WYSIWYG interface 14 receives input moving the object beyond the bounds in a particular state and, in response, the attribute adjuster 15 updates the bounds and the position of the object in other states based on the updated bounds. The creation application 13 may be used to export, publish, or otherwise create one or more files comprising computer-readable medium that defines the electronic content for display on other computer devices.

One exemplary embodiment involves managing the positioning and sizing of objects in multi-state electronic content by calculating bounds after each edit that could affect the size or position of an object. In an exemplary content creation application, before the user begins editing, each of the different states is assessed and information about bounds is stored. In response to edits that could affect the position or size of the object, the application recalculates the visual bounds in the current state and then determines a union of all the bounds across all the states to determine whether or not to adjust to the origin and/or size of the bounds. Bounds in any one state could be determined, for example, by combining the individual bounds of all children. As a specific example, bounds can be determined by iterating through and adding all the direct children of the parent. Preferably, this includes the entire stroke and any constraints. If the origin needs to be updated, the application adjusts all the position and/or size attributes of the objects according to predetermined rules. For example, left/top constraints and x/y values of the child objects can be adjusted. An example of updating size involves adjusting right/bottom constraints so that constrained items do not move with the changing edge. The application may use optimization or caching strategies such that bounds are recalculated only in response to some edits. In one exemplary application, a content creator can turn off such automatic bounds adjustment features to manually manage bounds. The application may present one or more graphical representations that allow bounds to be adjusted directly on a WYSIWYG interface. When the bounds are changed, the application may adjust any affected objects to account for the new bounds, for example, so that the objects are not inadvertently moved to new positions. Alternatively, the application may choose to not adjust any objects, allowing the updated bounds to cause the object to change position and/or size.

Figure 2:
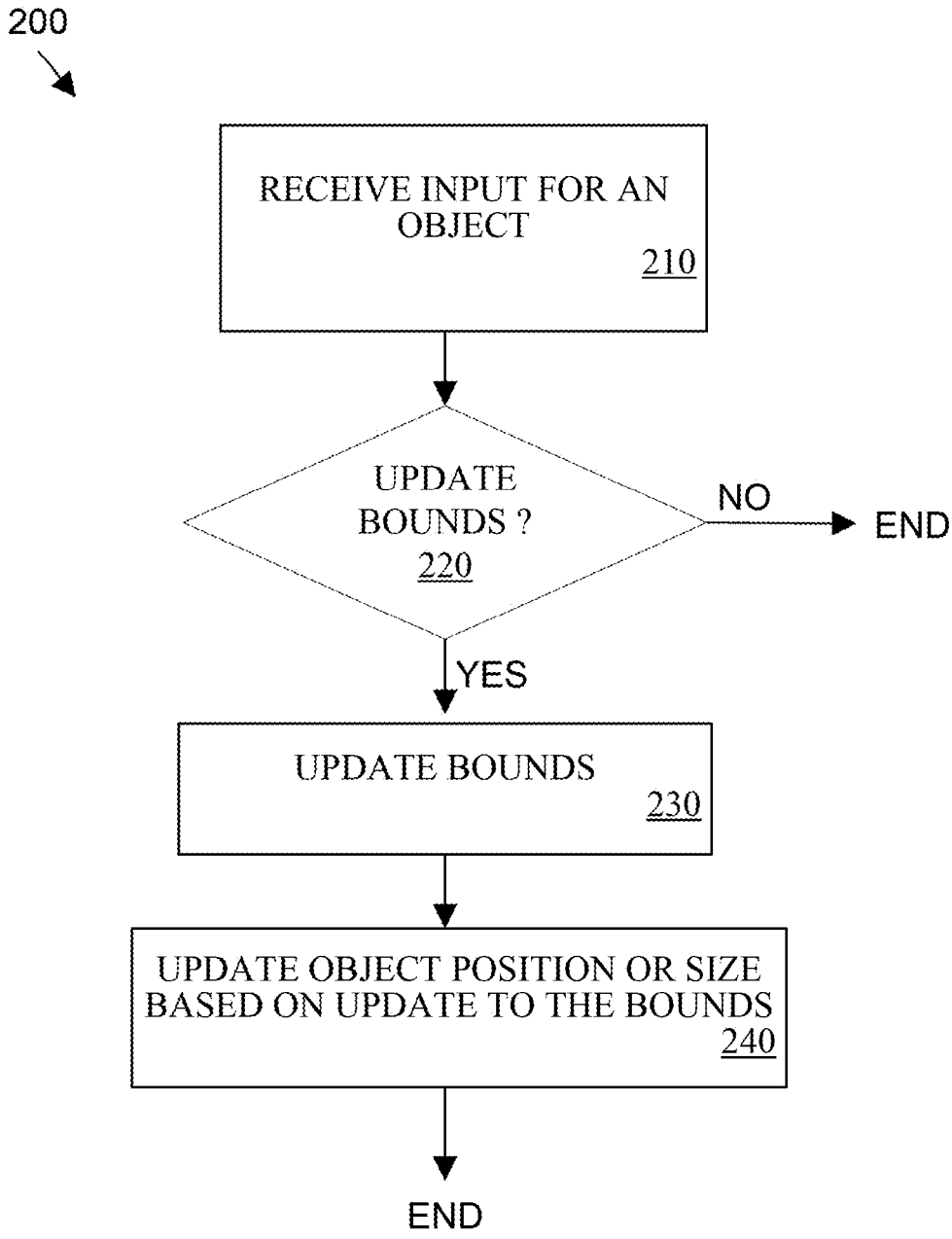
FIG. 2 is a flow chart illustrating an exemplary computer-implemented method of managing the positioning and sizing of an object in a multi-state electronic content.

FIG. 2 is a flow chart illustrating an exemplary computer-implemented method 200 of managing the positioning and sizing of an object in a multi-state electronic content. The exemplary method involves receiving input for an object, as shown in block 210. For example, this may involve receiving, in an electronic content creation application provided on a computer device such as the creation application 13 of device 10, input for an object of electronic content being edited. The object may be associated with bounds that is the same for multiple states of the object. Position and/or size attributes of the object may be defined with respect to the bounds and may vary for different states of the multiple states. The input received in block 210 may modify the position or size attributes of the object in at least one state of the multiple states. For example, the input may comprise a command to move, resize, rotate, delete, or add the object.

Figure 3B:
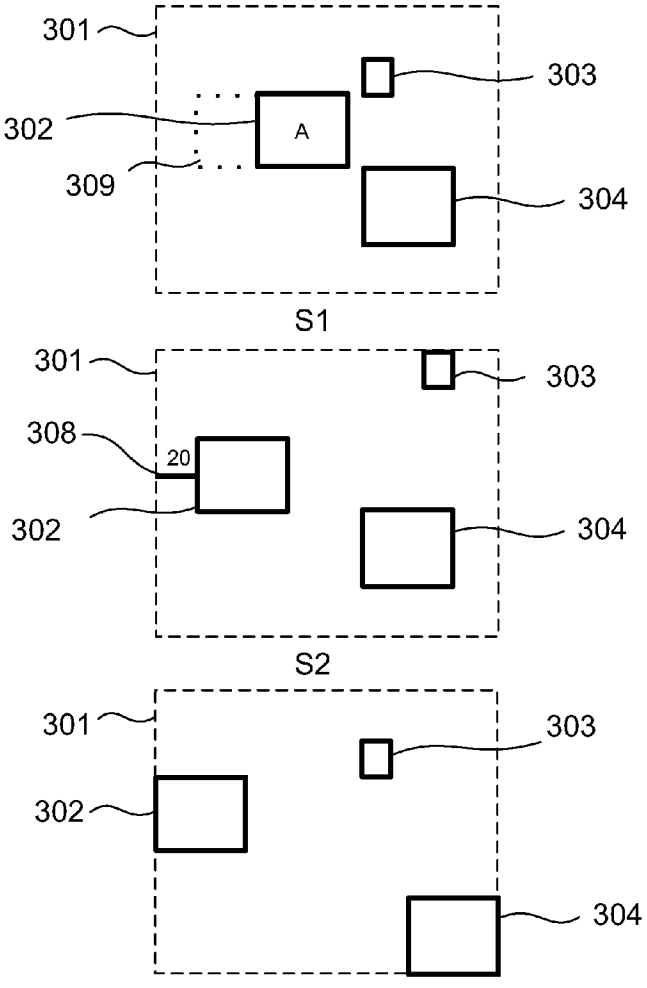
FIGS. 3A-B depict a response to receiving input moving an object that does not result in updating bounds.
Figure 3A:
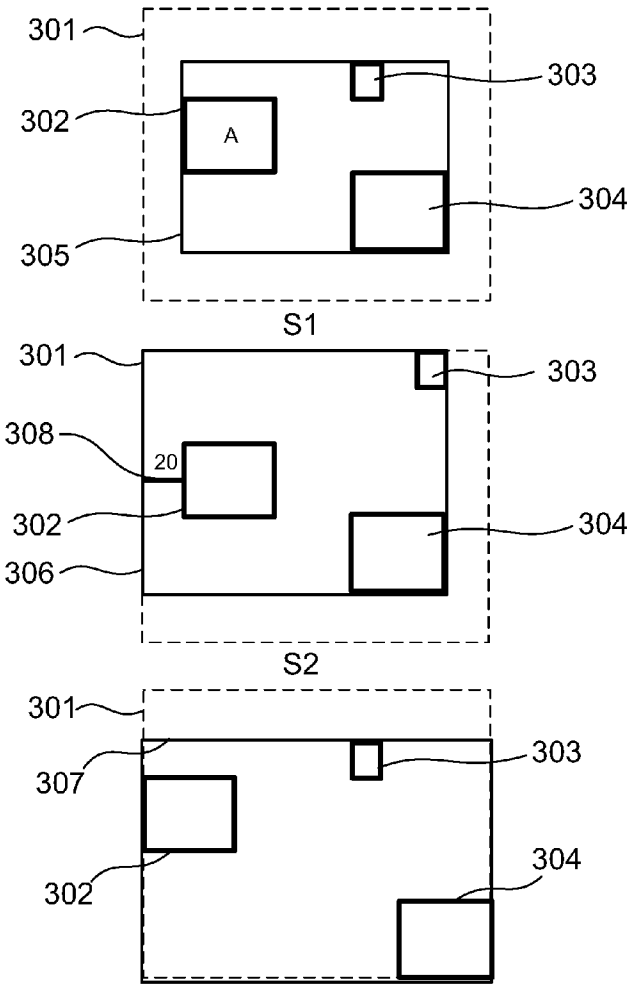

The exemplary method 200 further involves determining whether to update the bounds associated with the object based on the received input, as shown in block 220. Determining whether to update the bounds or not may depend on whether the input results in an edit that moves or otherwise positions the object beyond the bounds or not. FIGS. 3A-B depict a response to receiving input moving an object that does not result in updating bounds. In FIG. 3A, electronic content is shown in 3 states: S1, S2, and S3. Objects 302, 303, and 304 are included as a group in each state. Bounds 301 is the same in each of the three states and is positioned and sized to encompass each of the objects 302, 303, and 304 in all three states. In this example, the position of object 303 in state S2 determines the top edge of bounds 301, the position of object 302 in state S3 determines the left edge of the bounds 301, and the object 304 in state S3 determines the bottom and right edges of the bounds 301. For illustrative purposes, areas 305, 306, and 307 are shown to illustrate areas that could be included in state-specific bounds. However, to ensure that bounds 301 is the same across all three states, bounds 301 is larger than any of the state-specific minimum areas. Constraint 308 graphically illustrates that, in state S2, object 302 has a constraint specified such that the position of object 302 in state S2 will remain 20 units away from the left edge of bounds 301.

FIG. 3B illustrates the result of input moving object 302 in state S1 from its pre-edit position shown as dashed box 309 to a new position shown as 302 in FIG. 3B. In this example, determining whether to update the bounds associated with the object based on the received input can involve recognizing that, given the position of object 302 in state S3, that the movement of 302 in state S1 does not require updating of bounds 301. For example, the left edge of bounds 301 can be maintained given a rule that bounds will move inward when possible so that the bounds covers a minimum rectangle or other area that includes all objects in all states unless an object's position in one of the states is constrained by the current position of the bounds edge that would be moved. In this example, object 302 in state S3 defines the left edge, as does the position of 302 in state S2 along with its associated constraint 308.

Determining whether to update the bounds or not may additionally or alternatively depend on whether the input is of a particular type. For example, a movement of an object on a WYSIWYG interface beyond a bounds may be interpreted as associated with an intention to expand the bounds while input specifying negative value for an object's position or constraint may be interpreted as associated with an intention to position an object outside of the bounds. For example, to specify an animation involving an object moving in from outside of a window, a first state may include the object outside of the bounds and a second state may include the object within the bounds.

Figure 4B:
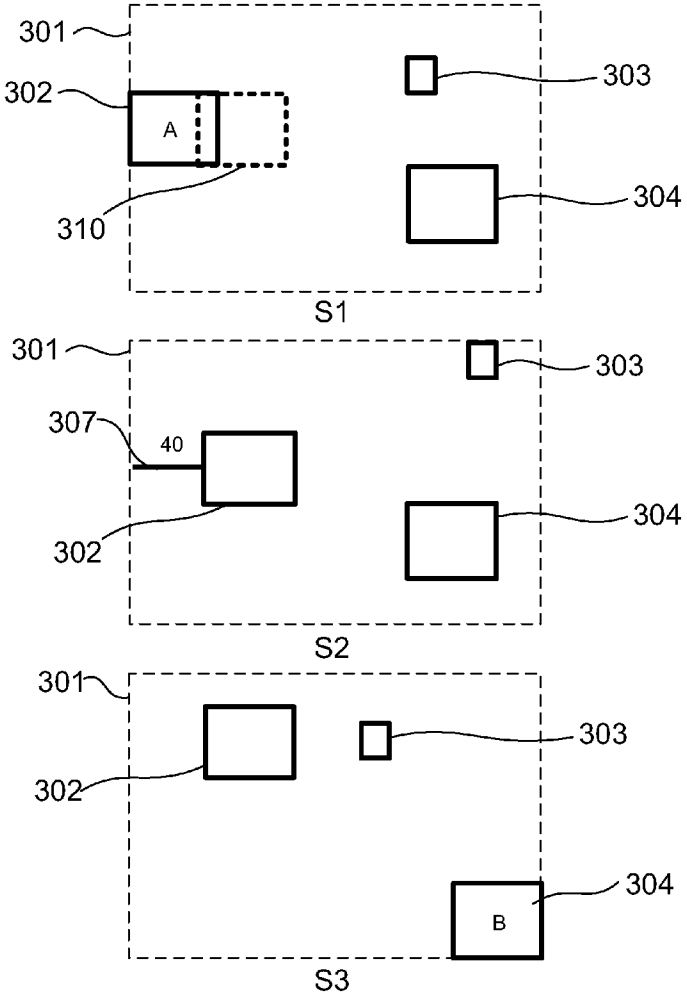
FIGS. 4A-B depict a response to receiving input moving an object that results in updating bounds and updating object position attributes.
Figure 4A:
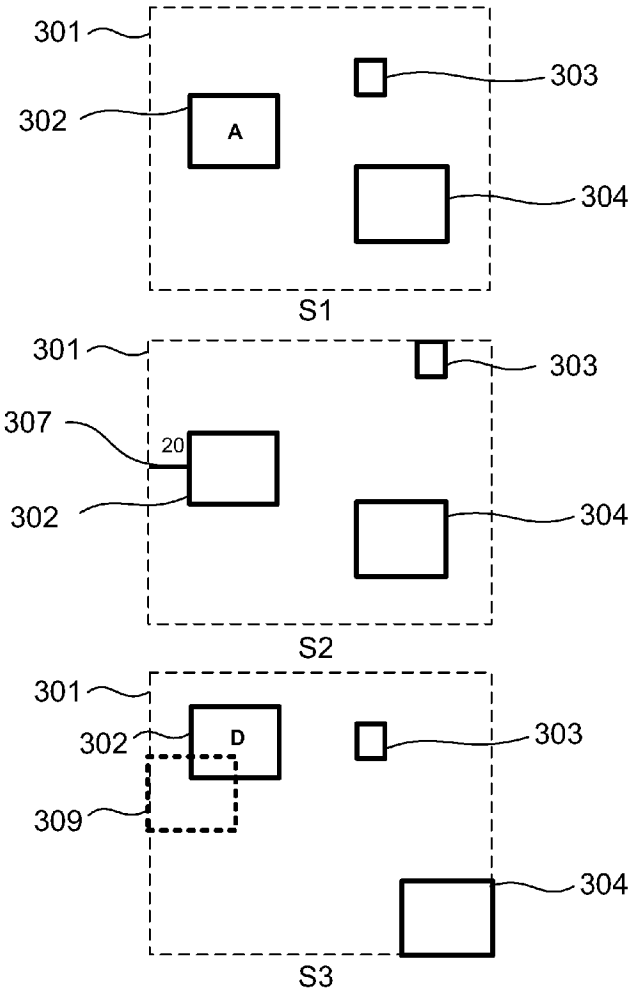

Returning to FIG. 2, if updating the bounds is necessary as determined by block 220, the exemplary method 200 may further involve updating the bounds, as shown in block 203, and updating the object position or size based on the update to the bounds, as shown in block 204. Updating of the position attribute or size attribute of the object may involve updating the position attribute of the object in other states of the multiple states based on the updating of the bounds. FIGS. 4A-B depict a response to receiving input moving an object that results in updating bounds and updating object position attributes. FIG. 4A illustrates the electronic content of FIG. 3B. In FIG. 4B, object 302 is moved in state S1 from its previous position 310 to the new position shown in FIG. 4B. In response to this edit, the bounds 301 is updated. Specifically, the left edge of the bounds 301 expands so that object 302 in state S1 remains within the bounds. The position attributes of object 302 are adjusted based on the changed bounds. In this example, the position of object 302 in state S3 was defined based on an origin of the bounds. Updating this bounds caused the origin of the bounds to change. Accordingly, the position attributes of object 302 in state S3 are adjusted to account for that change. Similarly, the position of object 302 in S2 is defined based on a constraint 307. This constraint is adjusted from "20" to "40" to account for the change in the bounds 301.

The exemplary method 200 of FIG. 2 may further involve updating position attributes or size attributes of one or more other objects of the electronic content being edited that are associated with the same bounds. Thus, in FIG. 4 the position attributes of elements 303 and 304 in each of the states are adjusted to account for the changed bounds 301. As another example, multiple objects may be children of the same parent object. An edit to one object which causes an update to the parent object's bounds may result in new position attributes for the other child objects.

Figure 5B:
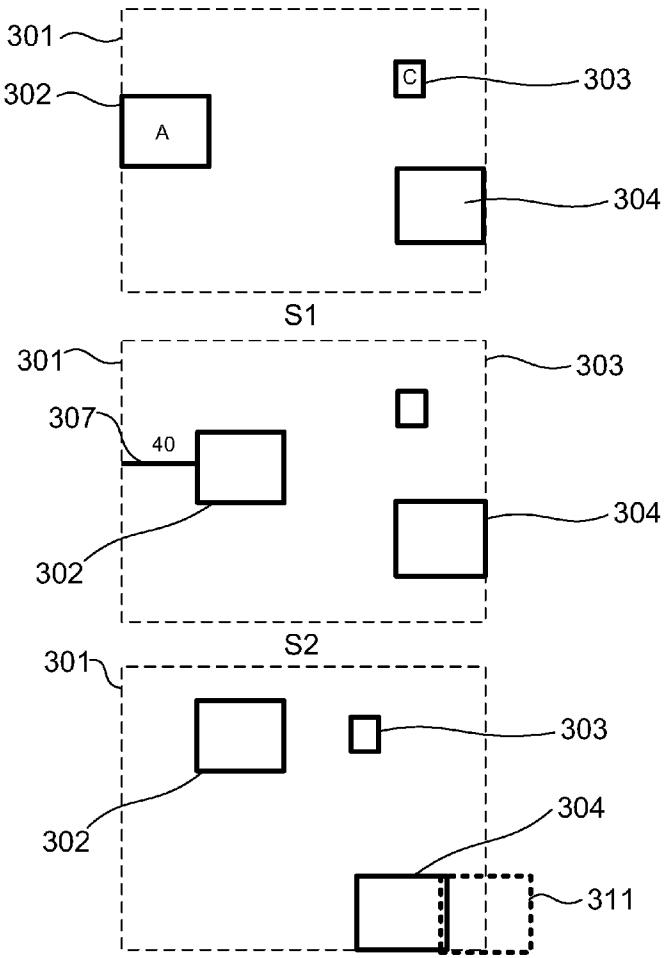
FIGS. 5A-B depict a response to receiving input moving an object that results in updating bounds.
Figure 5A:
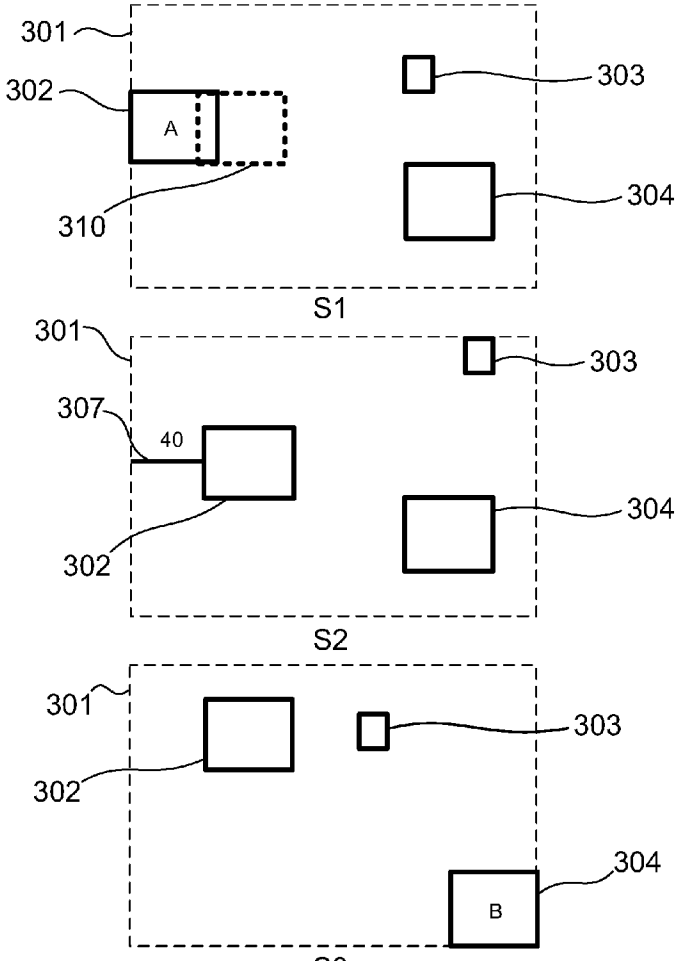

FIGS. 5A-B depict a response to receiving input moving an object that results in updating bounds. FIG. 5A illustrates the electronic content of FIG. 4B. In FIG. 5B, object 304 is moved in state S3 from its previous position 311 to the new position shown in FIG. 5B. In response to this edit, the bounds 301 is updated. Specifically, the right edge of the bounds 301 changes to minimize the size of the bounds 301 while ensuring that the objects 302, 303, and 304 are all within it but does not need to update any object's size and/or position attributes. Since no objects refer to the right edge, no further updates are needed.

Figure 6B:
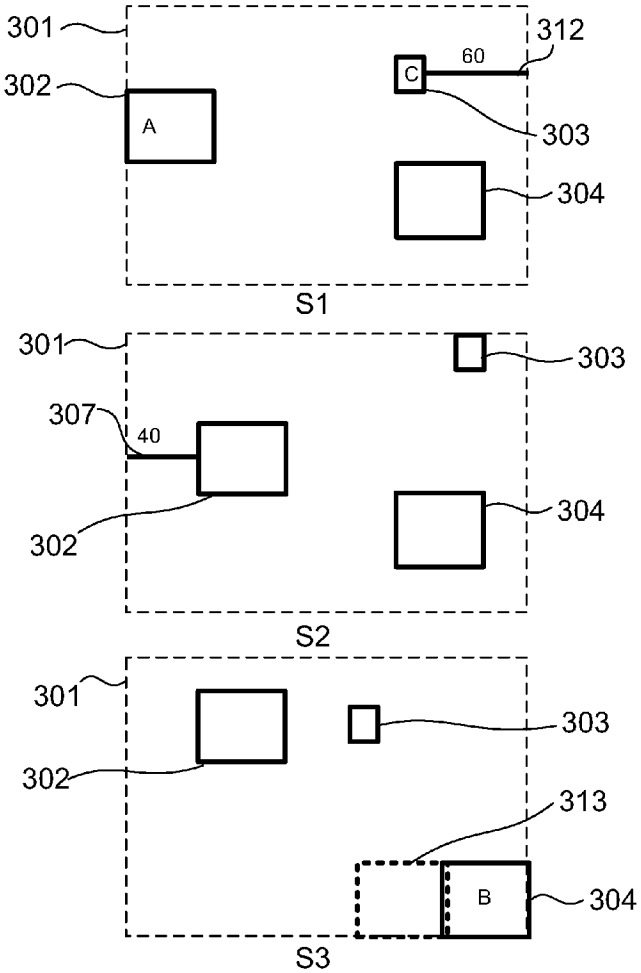
FIGS. 6A-B depict a response to receiving input moving an object that results in updating bounds and updating object position attributes.
Figure 6A:
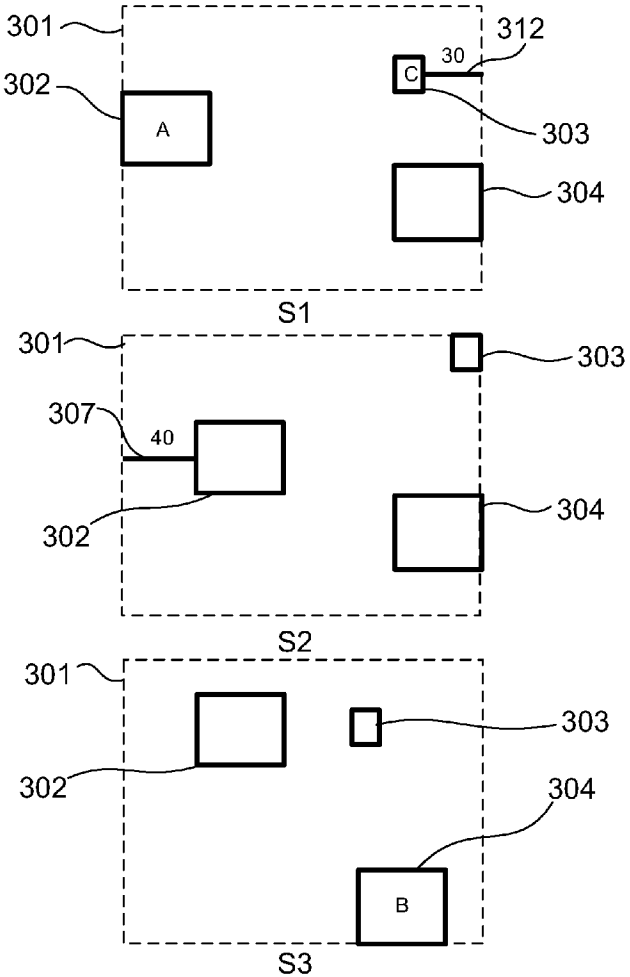

FIGS. 6A-B depict a response to receiving input moving an object that results in updating bounds and updating object position attributes. FIG. 6A illustrates the electronic content of FIG. 5B with an additional constraint 312 defined for object 303 in state S1. In FIG. 6B, object 304 is moved in state S3 from in previous position 313 to the new position shown in FIG. 6B. In response to this edit, the bounds 301 is updated. Specifically, the right edge of the bounds 301 changes to ensure that the objects 302, 303, and 304 are all within it in all states. The position attributes are also changed accordingly. In this example, the constraint 312 is updated from "30" to "60" units so that object 303 maintains its same relative position.

Figure 7B:
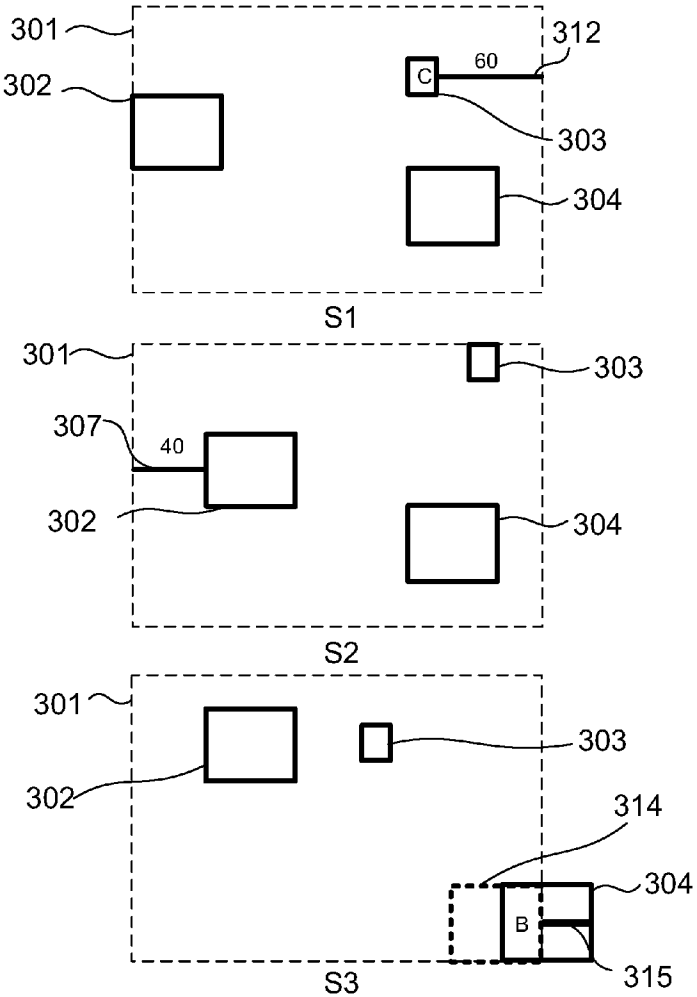
FIGS. 7A-B depict a response to receiving input moving an object that does not result in updating bounds.
Figure 7A:
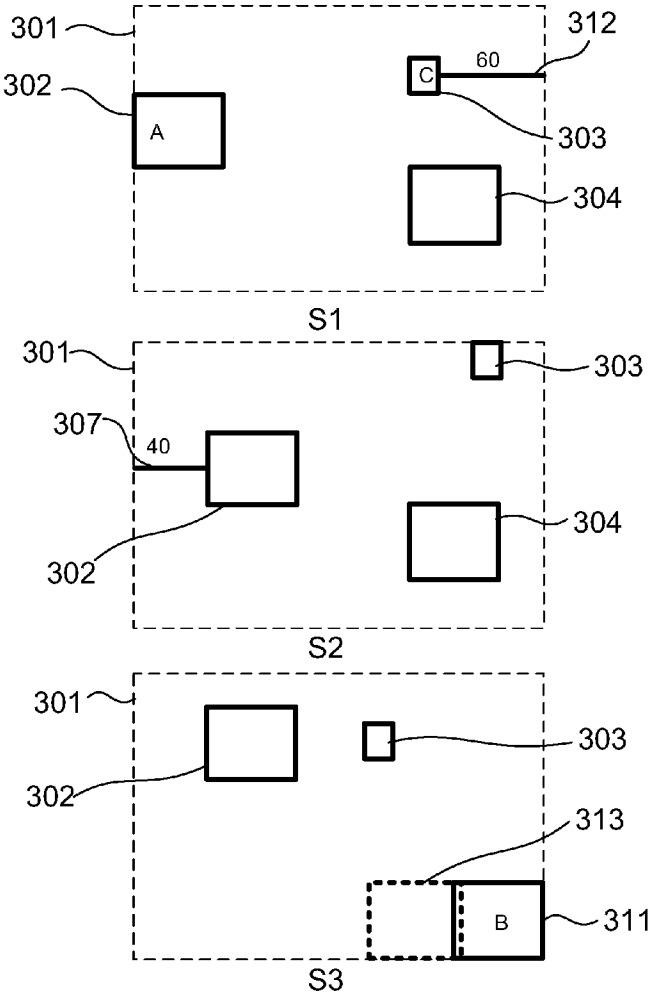

FIGS. 7A-B depict a response to receiving input moving an object that does not result in updating bounds. FIG. 7A illustrates the electronic content of FIG. 6B. In FIG. 7B, object 304 is moved in state S3 from in previous position 314 to the new position shown in FIG. 7B. However, in this example the input is such that it is interpreted as associated with an intention that the bounds not expand, i.e., that the object given the negative constraint be placed at least partially beyond the bounds. In response to this edit, the bounds 301 is not updated.

Figures 8A, 8B:
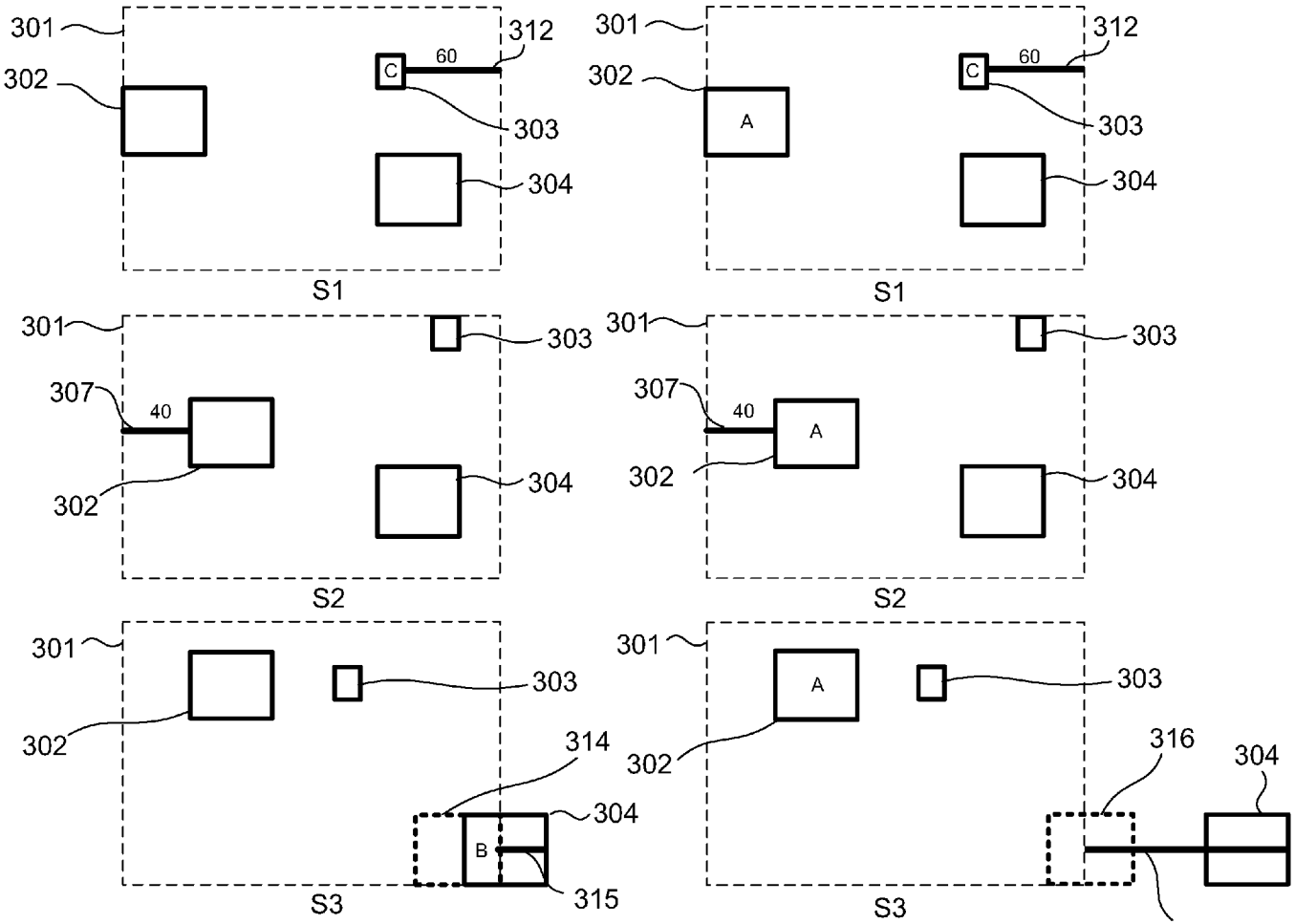
FIGS. 8A-B depict a response to receiving further input moving an object that does not result in updating bounds.

FIGS. 8A-B depict a response to receiving further input moving an object that does not result in updating bounds. FIG. 8A illustrates the electronic content of FIG. 7B in which object 304 was given a negative constraint 315. In FIG. 8B, input is received that moves object 304 further to the right from its previous position 316 to its new position 304 shown in FIG. 8B. Because object 304 was already associated with a prior edit that was determined should not update the bounds, this update is treated as associated with an intention that the bounds 301 not be updated. Accordingly, in response to the input, the bounds 301 remains the same. Given that the bounds 301 remains the same, the negative constraint 315 is updated accordingly.

Figure 9B:
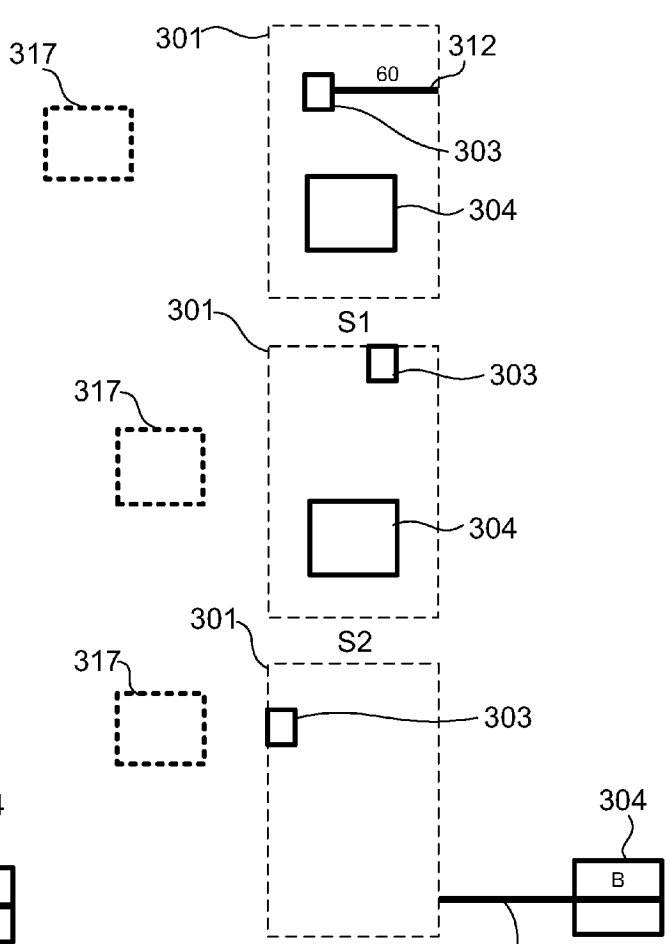
FIGS. 9A-B depict a response to receiving input deleting an object that results in updating bounds and position attributes.
Figure 9A:
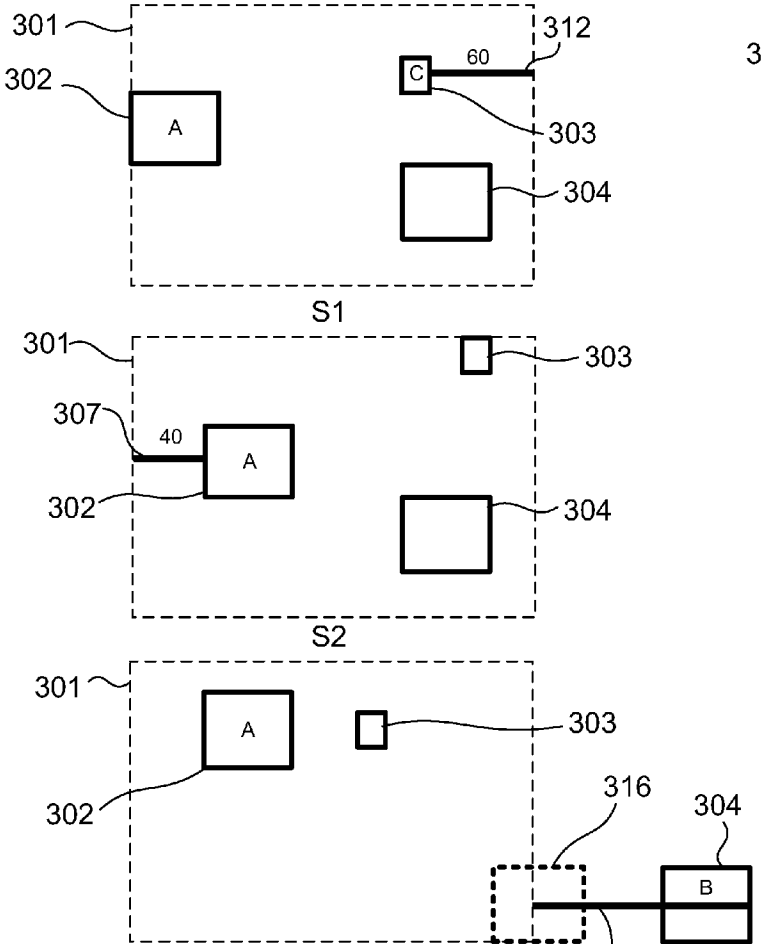

FIGS. 9A-B depict a response to receiving input deleting an object that results in updating bounds and position attributes. FIG. 9A illustrates the electronic content of FIG. 8B. In FIG. 9B, input is received that deletes item 302 as depicted by representations 317. In response to this edit, the bounds 301 is updated. Specifically, the left edge of the bounds 301 changes to minimize the size of the bounds 301 while ensuring that the remaining objects 303 and 304 remain within it, with the exception that object 304 of state S3 can remain outside of the bounds 301 according to the earlier intention to place it outside the bounds. In one exemplary embodiment, input is received that is a command to reparent an object to be a child of a new parent object instead of its prior parent object. The prior parent object may be adjusted as if the object were deleted from it and the new parent object and any associated child object may be adjusted as if the object were added at its new position.

Managing the positioning and sizing of objects in multi-state electronic content may also involve facilitating manual bounds adjustments. In one exemplary embodiment, an electronic content creation application receives a command to manually manage bounds. It may then receive a second input modifying the bounds. Given this second input modifying the bounds, the content creation application determines whether to update the position attribute or the size attribute of one or more of the objects in the multiple states. While the electronic content creation application is in such a manual bounds management mode, it will not automatically update the bounds based on input modifying the position attribute or size attribute of the object associated therewith. Thus, a content creator may switch to such a manual mode as a convenient mode in which objects can be moved without changing the bounds, for example, to move an object outside of the bounds in a particular state. The provision of both an automatic bounds feature and a manual mode can provide flexibility, ensure that editing of content does not produce unexpected bounds or object behavior.

Methods and systems are disclosed that manage the positioning and sizing of objects in electronic content that can provide certain features that facilitate reparenting of objects. Such systems and methods are generally useful for groups of objects whose size and/or positions is defined relative to a set of bounds. Since multiple sets of bounds may exist within a given piece of electronic content being created, it is often desirable to change the set with which one or more objects is associated. In this context, a "parent" is any object that defines or provides a set of bounds regardless of whether there is literal parent-child containment. Accordingly, a reparenting action can change the association of bounds for one or more objects. For example, moving an object from one parent to another can change the set of bounds to which that object is associated. In addition, one set of bounds may be defined relative to another set of bounds, for example if one of a parent's children is itself a parent. In some circumstances, each of the different sets of bounds in electronic content being developed can be interpreted relative to an absolute frame of reference, for example, bounds of entire piece of electronic content being developed, e.g., where an outermost parent defines such bounds.

Figure 10:
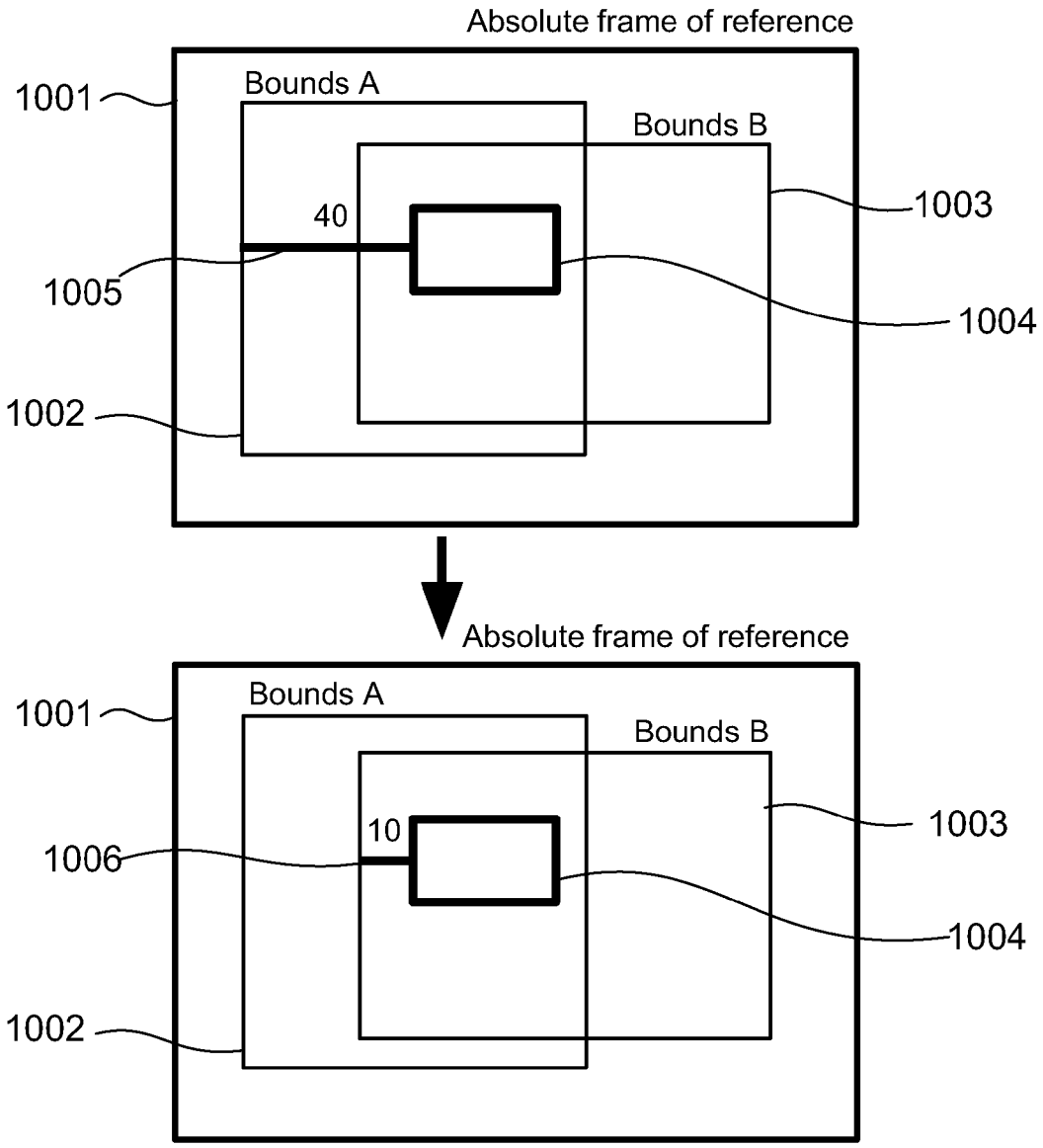
FIG. 10 illustrates an example of reparenting an object from one set of bounds to another set of bounds.

FIG. 10 illustrates an example of reparenting an object 1004 from one set of bounds to another set of bounds. In this example, the object's size and position are maintained relative to the absolute frame of reference 1001 by adjusting the size and position constraints of the object 1004, so that, relative to the new parent bounds 1003, those constraints yield the same size and position in the absolute frame of reference 1001 as before. Specifically, when reparenting the object 1004 from original parent bounds 1002 to new parent bounds 1003, the left position of the object 1004 is adjusted from forty units from the original parent bounds 1002 as defined by constraint 1005 to ten units from the new parent bounds 1003 as defined by constraint 1006 in order to preserve the same position relative to the absolute frame of reference 1001.

Figure 11:
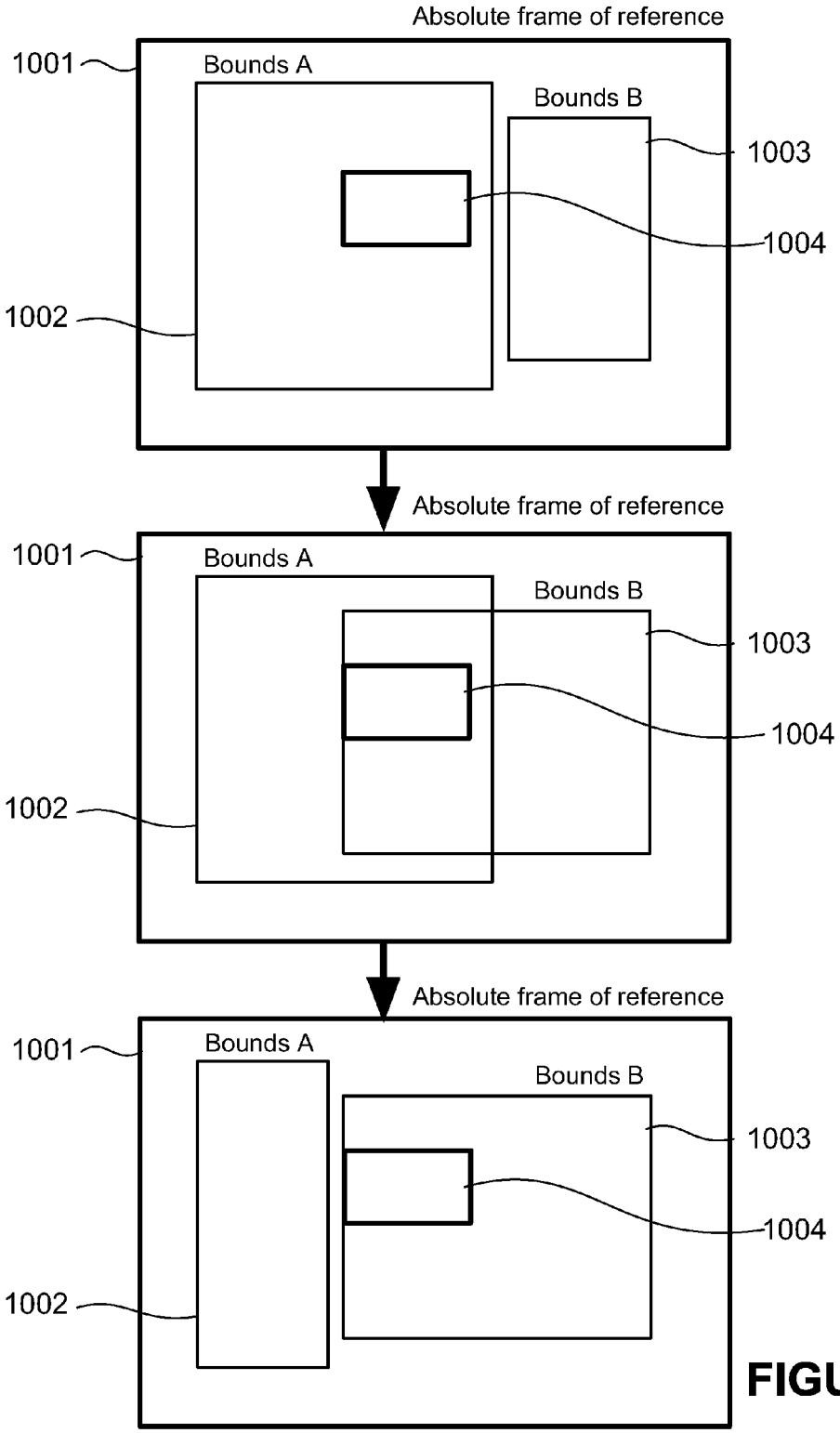
FIG. 11 illustrates an example of reparenting resulting in a change to the bounds of an original parent bounds and a new parent bounds.

FIG. 11 illustrates an example of reparenting resulting in a change to the bounds of an original parent bounds and a new parent bounds. Generally, reparenting may change the bounds of either the original or the new parent, in which case the size and position constraints of all the children in those parents may be adjusted as with any other bounds change. Reparenting can be implemented as a deletion operation from the standpoint of the original parent bounds, plus an addition insertion operation from the standpoint of the new parent bounds. In this example, reparenting the object 1004 from the original parent bounds 1002 to the new parent bounds 1003 causes the new parent bounds 1003 to grow to encompass the object 1004 and It may also cause the old parent bounds 1002 to reduce in size.

Reparenting may also involve preserving the reparented object's layout behavior, i.e. how its size and position changes as the various bounds are adjusted. To preserve this, both the object's size and position constraint and the new parent's own size and position constraints may be adjusted. In one embodiment, if a given edge or other anchor point of the object was defined relative to an edge of the original parent's bounds, that edge or point of the object may be made relative to the same edge on the new parent's bounds, and that edge of the parent's bounds may be made relative to the original edge on the original parent's bounds. This creates an unbroken chain of constraints from the edge or point of the object to the original bounds edge.

Figure 12:
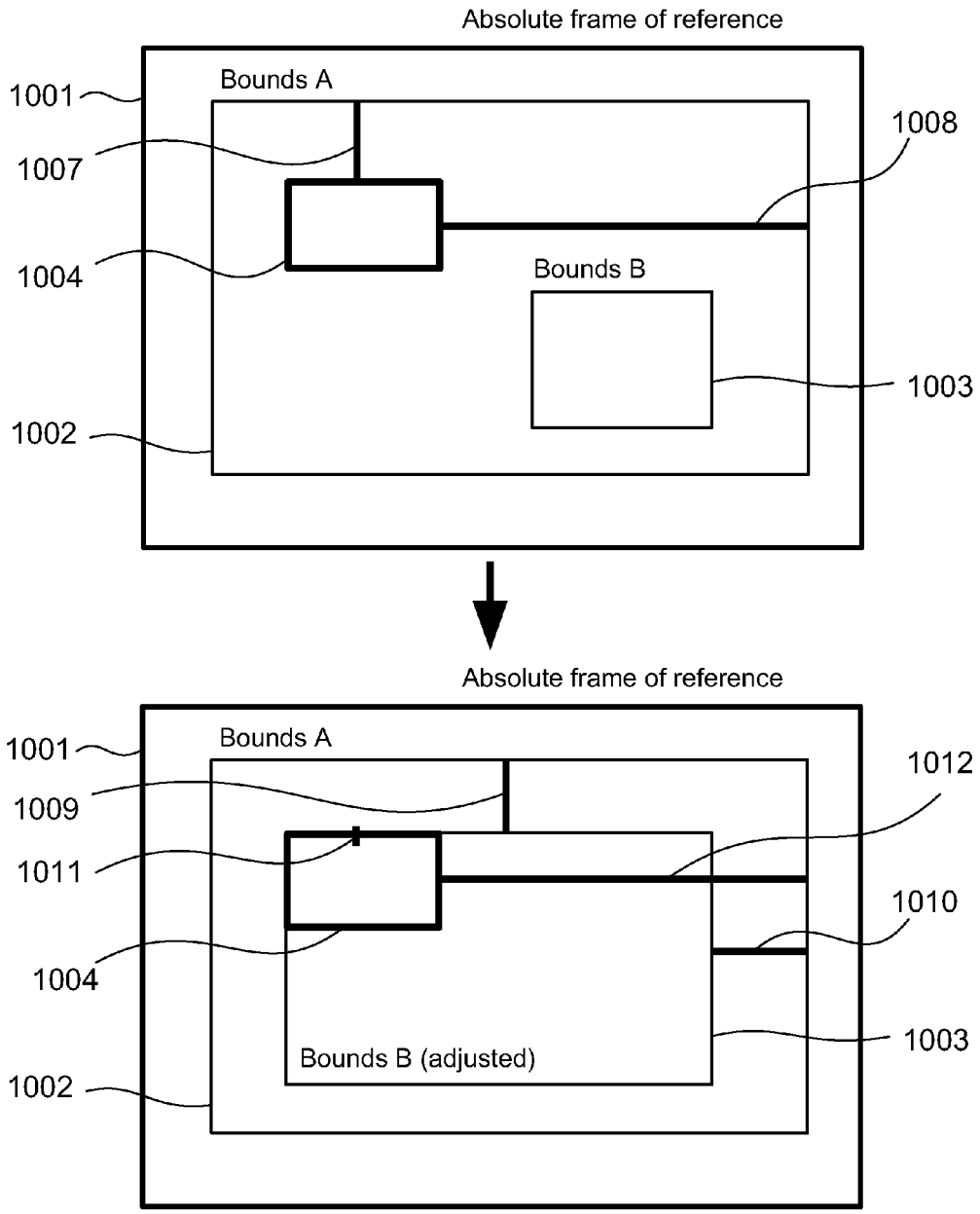
FIG. 12 illustrates an example of reparenting an object from an original parent bounds to a new parent bounds that causes new parent bounds to itself be constrained by the original parent bounds.

FIG. 12 illustrates an example of reparenting an object from an original parent bounds 1002 to a new parent bounds 1003 that causes new parent bounds 1003 to be constrained by the original parent bounds 1002. Prior to the reparenting, the position of the object 1004 was constrained by constraints 1007, 1008 to edges of the original parent bounds 1002. After the reparenting, the position of the object 1004 is constrained by constraints 1011, 1012 to the new parent bounds 1003 and the new parent bounds 1003 is itself constrained relative to the original parent bounds 1002 by constraints 1009, 1010. Thus, when the old parent bounds 1002 is changed, the new parent bounds 1003 also changes, in turn changing the position of object 1004, preserving the same original parent bounds 1002 to object 1004 relative position as before the reparenting.

Figure 13:
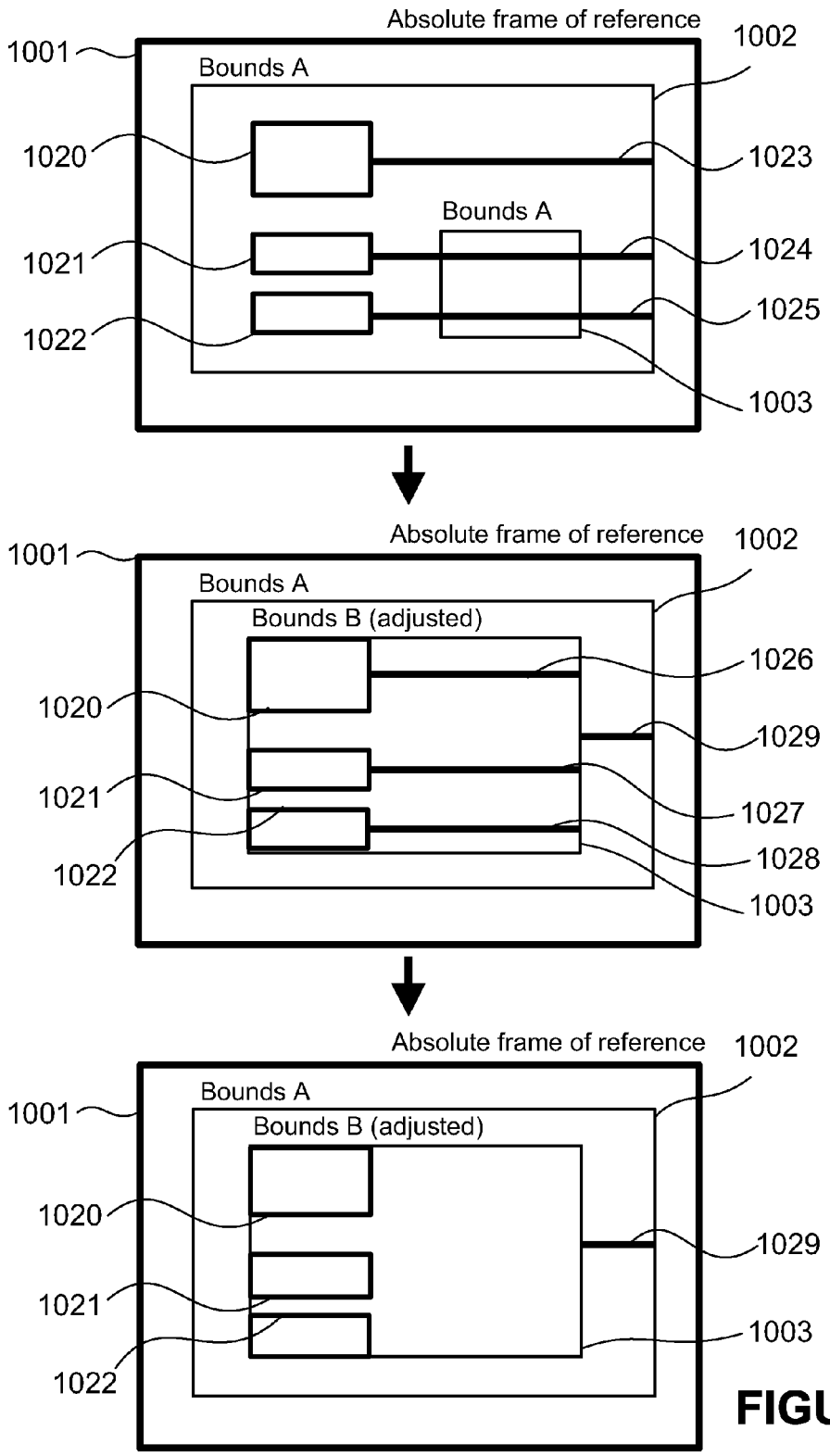
FIG. 13 illustrates an example of simplifying constraint use in the reparenting of objects.

FIG. 13 illustrates an example of simplifying constraint use in the reparenting of objects. In this example, objects 1020, 1021, 1022 are reparented from original parent bounds 1002 to new parent bounds 1003. The prior constraints 1023, 1024, and 1025 to the original parent bounds are removed. New parent bounds 1003 is expanded, new constraints 1026, 1027, 1028 are added defining the position of objects 1020, 1021, 1022 relative to the new parent bounds, and new constraint 1029 is introduced to define the position of the new parent bounds 1003 relative to the old parent bounds 1002. The system then determines to remove constraints 1026, 1027, and 1028 shared by all the objects 1020, 1021, 1022 based on a determination that the constraint 1029 applied to the new parent bounds 1003 is sufficient alone to provide the original layout behavior.

Figure 15:
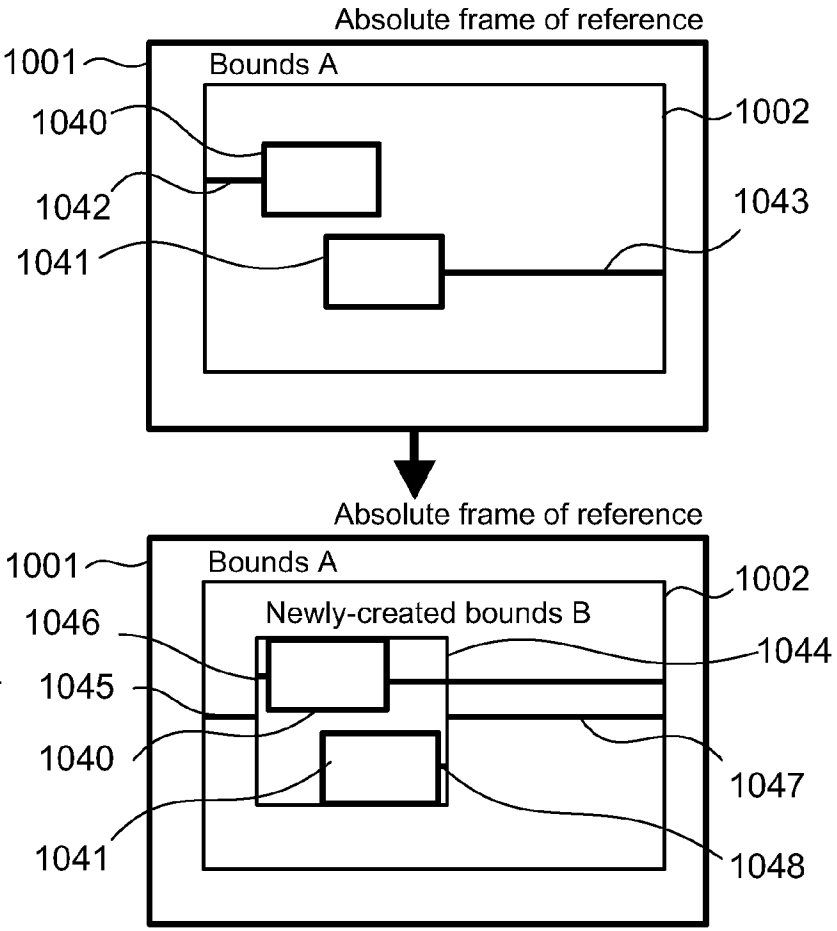
FIG. 15 illustrates another example of using constraints in the reparenting of objects.
Figure 14:
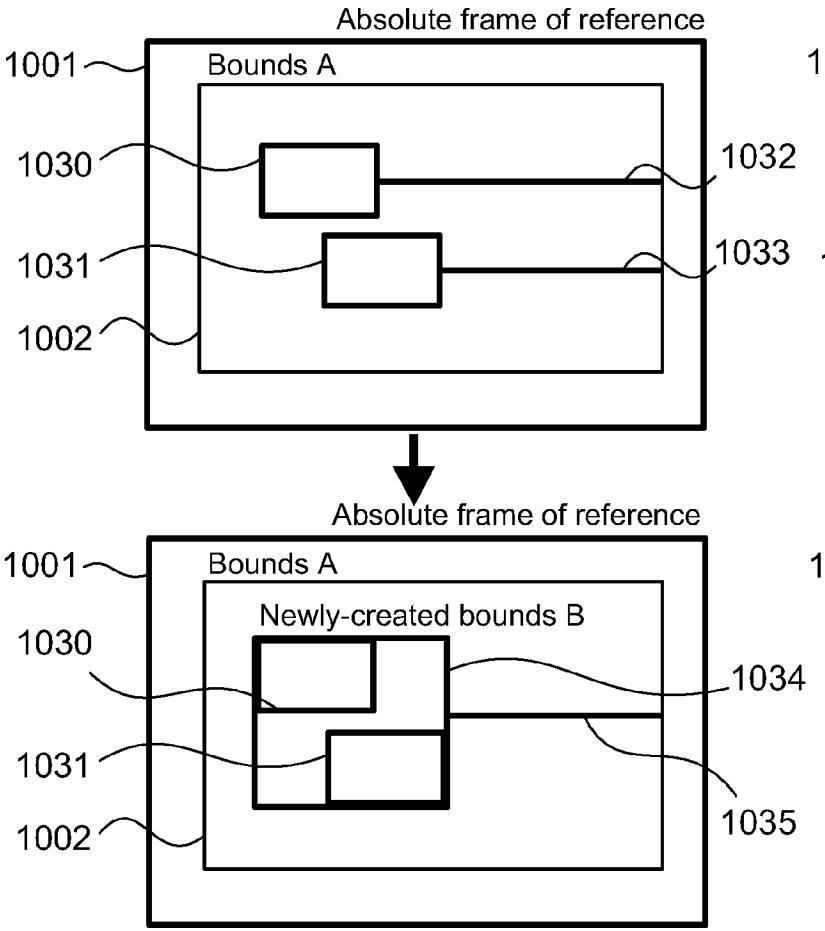
FIG. 14 illustrates another example of simplifying constraint use in the reparenting of objects.

FIG. 14 and FIG. 15 illustrate additional examples of using constraints in the reparenting of objects. In the example of FIG. 14, an operation that creates a new parent bounds 1034 is received and the system determines that the original layout behavior as defined by constraints 1032, 1033 on objects 1030, 1031 can be maintained by simply introducing constraint 1035 defining the position of new parent bounds 1034 to the original parent bounds 1002. Similarly, in the example of FIG. 15, an operation that creates a new parent bounds 1044 is received and the system determines that the original layout behavior as defined by constraints 1042, 1043 on objects 1040, 1041 can be maintained by introducing constraints 1045, 1047 defining the position of new parent bounds 1044 to the original parent bounds 1002 and constraints 1046, 1048 defining the relationship of objects 1040, 1041 to the new parent bounds 1044, respectively.

General

Numerous specific details are set forth herein to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values, beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed:

1. A computer-implemented method comprising:

receiving, in an electronic content creation application provided on a computer device, input for an object of electronic content being edited in the electronic content creation application, wherein the object is associated with a bounds that is the same for multiple states of the object, wherein a position attribute or a size attribute of the object that is defined with respect to the bounds can vary for each state of the multiple states, and wherein the input modifies the position attribute or size attribute of the object in at least one state of the multiple states;

determining, in the electronic content creation application, whether to update the bounds associated with the object based on the input; and based on determining to update the bounds, in the electronic content creation application:

updating the bounds associated with the object to ensure that all child objects are within the bounds in all of the multiple states; and updating the position attribute or the size attribute of the object based on the updating of the bounds.

2. The method of claim 1 wherein the input comprises a command editing the object to extend beyond the bounds in a state of the multiple states and wherein the updating of the position attribute or size attribute comprises updating the object in other states of the multiple states based on the updating of the bounds.

3. The method of claim 1 wherein the input comprises a command to move, resize, rotate, delete, or add the object.

4. The method of claim 1 further comprising, in the electronic content creation application, updating position attributes or size attributes of one or more other objects of the electronic content being edited that are associated with the same bounds.

5. The method of claim 4 wherein the object and the one or more other objects are children of a same parent object, wherein an edit applied to the parent object in the electronic content creation application also affects the children.

6. The method of claim 5 wherein the input comprises a command to reparent the object to be a child of said same parent object instead of its prior parent object.

7. The method of claim 1 further comprising creating, in the electronic content creation application, a file comprising non-transitory computer-readable medium that defines the electronic content for display on other computer devices.

8. The method of claim 1 further comprising:

receiving, in the electronic content creation application, a command to manually manage the bounds;

receiving, in the electronic content creation application, a second input modifying the bounds; and updating the position attribute or the size attribute of the object in the multiple states based on the modifying of the bounds.

9. The method of claim 8 wherein, while the electronic content creation application is in a manual bounds management mode, any additional input modifying the position attribute or size attribute of the object does not result in an automatic change to the bounds.

10. The method of claim 1 wherein the input is received in the electronic content creation application on a what-you-see-is-what-you-get (WYSIWYG) interface displaying the object and the bounds.

11. A system comprising:

a processor executing instructions stored in a non-transitory computer-readable medium to provide an application, the application comprising:

a module for providing a what-you-see-is-what-you-get (WYSIWYG) interface, the WYSIWYG interface configured to receive input for an object of electronic content being edited, the object associated with a bounds used for multiple states of the object, a position attribute or a size attribute of the object defined with respect to the bounds and variable for each state of the multiple states, and the input modifying the position attribute or size attribute of the object in at least one state of the multiple states; and a module for adjusting attributes, the module for adjusting attributes to update the bounds of the object based on the input to the WYSIWYG module to ensure that all child objects are within the bounds in all of the multiple states and update the position attribute or the size attribute of the object based on the update of the bounds.

12. The system of claim 11 wherein the WYSIWYG interface is configured to receive the input as a command to move the object beyond the bounds in a state of the multiple states, and wherein the module for adjusting attributes is further configured to update the position attribute of the object in other states of the multiple states based on the update of the bounds.

13. The system of claim 11 wherein the input comprises a command to move, resize, rotate, delete, or add the object.

14. The system of claim 11 wherein the module for adjusting attributes is further configured to update position attributes or size attributes of one or more other objects of the electronic content being edited that are associated with the same bounds.

15. The system of claim 11 wherein the input comprises a command to reparent the object.

16. The system of claim 11 wherein the module for providing the WYSIWYG interface provides a manual bounds managing mode wherein the WYSIWYG interface is capable of receiving a second input modifying the bounds and wherein the module for adjusting attributes updates the position attribute or the size attribute of the object in the multiple states based on the modifying of the bounds.

17. A non-transitory computer-readable medium on which is encoded program code, the program code comprising:

program code for receiving input for an object of electronic content being edited, wherein the object is associated with a bounds that is the same for multiple states of the object, wherein a position attribute or a size attribute of the object that is defined with respect to the bounds can vary for each state of the multiple states, and wherein the input modifies the position attribute or size attribute of the object in at least one state of the multiple states;

program code for determining whether to update the bounds associated with the object based on the input; and program code for, based on determining to update the bounds, updating the bounds associated with the object to ensure that all child objects are within the bounds in all of the multiple states and updating the position attribute or the size attribute of the object based on the updating of the bounds.

18. The non-transitory computer-readable medium of claim 17 wherein the input comprises a command moving the object beyond the bounds in a state of the multiple states and wherein the updating of the position attribute or size attribute comprises updating the position attribute of the object in other states of the multiple states based on the updating of the bounds.

19. The non-transitory computer-readable medium of claim 17 wherein the input comprises a command to reparent the object to be a child of a new parent object instead of its prior parent object.

20. The non-transitory computer-readable medium of claim 17 further comprising:

program code for receiving a command to manually manage the bounds;

program code for receiving a second input modifying the bounds; and program code for updating the position attribute or the size attribute of the object in the multiple states based on the modifying of the bounds.

21. A computer-implemented method comprising:

receiving, in an electronic content creation application provided on a computer device, input for an object of electronic content being edited in the electronic content creation application, wherein, prior to the input, there is a first association between the object and the first bounds, wherein changing the first bounds changes a position attribute or a size attribute of the object, and determining, based on the input, in the electronic content creation application, to remove the first association;

determining, based on the input, in the electronic content creation application a second association between the object and the second bounds, wherein changing the second bounds changes the position attribute or the size attribute of the object; and determining, in the electronic content creation application, a third association between the second bounds and the first bounds, wherein changing the first bounds changes the second bounds to preserve a position or size of the object relative to the first bounds.

22. The method of claim 21 wherein:

the first association defines that a first anchor point of the object is a specified distance from a second anchor point of the first bounds, the second association defines that the first anchor point of the object is a second specified distance from a third anchor point of the second bounds; and the third association defines that the third anchor point of the second bounds is a third specified distance from the second anchor point of the first bounds.

* * * * *